US005915610A

United States Patent [19]

Russell

[11] Patent Number: 5,915,610

[45] Date of Patent: Jun. 29, 1999

[54] CARPENTER'S TOOL HOLDER

[76] Inventor: Steven W. Russell, 146 Clover Branch Rd., Elizabethton, Tenn. 37643

[21] Appl. No.: 09/026,409

[22] Filed: Feb. 19, 1998

[51] Int. Cl.[6] ..... A45F 5/14

[52] U.S. Cl. ..... 224/673; 224/197; 224/904

[58] Field of Search ..... 224/673, 904, 224/665, 666, 677, 682, 684, 197, 268, 614; D3/228; 211/70.6; 248/175, 206.5; 33/760, 767, 770

[56] References Cited

U.S. PATENT DOCUMENTS

| | | | |
|---|---|---|---|
| D. 248,066 | 6/1978 | Hillinger . | |
| D. 253,019 | 10/1979 | Hillinger . | |
| D. 328,191 | 7/1992 | Reitz . | |
| 4,106,679 | 8/1978 | Hillinger . | |
| 4,372,468 | 2/1983 | Harvey . | |
| 4,821,933 | 4/1989 | Seber . | |
| 5,100,037 | 3/1992 | Kopyta et al. | 224/245 |
| 5,673,830 | 10/1997 | Matthews | 224/268 |
| 5,695,104 | 12/1997 | Darling | 224/684 |
| 5,782,445 | 7/1998 | Cleck | 248/206.5 |

*Primary Examiner*—Allan N. Shoap
*Assistant Examiner*—Maerena W. Brevard
*Attorney, Agent, or Firm*—Malcolm G. Dunn

[57] ABSTRACT

A carpenter's tool holder to be supported from a wearer's waist belt and including a pocket for supporting and containing therein a tape rule device and a retention member connected within the pocket for interlocking engagement with the spring clip member attached to the rear surface of the tape rule device for preventing unintentioned dislodgment of the tape rule device from the pocket. A second embodiment includes below the pocket an elongated hanger member pivotally connected to the tool holder for supporting and containing a hammer and wherein the elongated hanger member has at its free end a tool loop defining therein an opening through which the handle of the hammer is inserted.

11 Claims, 3 Drawing Sheets

Fig. 5

CARPENTER'S TOOL HOLDER

BACKGROUND OF THE INVENTION

1. Field of the Invention

This invention pertains to tool holders, and more particularly relates to a carpenter's tool holder that is supported from a wearer's waist belt.

2. Description of the Prior Art

Carpenters, electricians, handymen/women, and other persons in the construction and repair trades generally want to carry the tools of their profession in some manner about their person for ease of access to the tools that they expect to use on the job.

In the prior art, various arrangements have been developed for holding about the waist of the wearer tool holders or tool pouches, which are capable of carrying multiple tools, including hammers, hatchets, screw drivers (both regular and Phillips), pliers (sometimes of different sizes), wire cutters, wrenches (of different sizes), tape rule devices, folding rules, flashlights, electrical insulating tapes, power drill Jacob's chuck keys, Allen wrenches, and many other kinds of tools that are considered convenient to have close at hand.

The inventor has found, however, that the collective weight of all of these tools during the course of a day's construction work becomes quite tiring and uncomfortable. Such multiple-tool pouches or tool holders may appear to be satisfactory to wear while one is walking around in an erect position, but when the wearer is bending and/or crouching on the job or climbing up and down ladders and crawling into tight spaces or over the surface of a roof, some tools will often fall out of the pouch or tool holder. The convenience of having all of the tools at hand, therefore, is offset somewhat by having to grab at tools to keep them from falling out or having to bend over to retrieve fallen tools. This interferes with giving attention to the job at hand.

Tape rule devices are essential tools to have and use in the construction trades. The inventor has found that it is inconvenient, however, to carry a tape rule device in his pocket because of the sheer bulk of it and the difficulty entailed in retrieving it from the pocket when he is in a crouched position, for example, on a job.

Some tape rule devices are provided by their manufacturer with spring clip members, which are usually attached to the rear wall of the tape rule device so that the spring clip member can be manually forced by the wearer downwardly over the top edge of the wearer's waist belt. The inventor, however, has also found that when using the spring clip member in this manner, the tape rule device often becomes accidently dislodged from his waist belt as he is getting in and out of a vehicle, or moving up and down ladders, or when climbing and bending or crawling over the surface of a roof or crawling into tight building spaces or crouching at a building site. In these situations and others, the bottom of the tape rule device will come into contact with the wearer's body and the spring clip member becomes dislodged from its retained position from the wearer's waist belt. Unless the wearer is quick enough to notice and grab the tape rule device, the device may drop to the roof and slide down over the surface of the roof and fall to the ground.

There are also known in the art leather tool pouches or holders for supporting only a single tape rule device that may be connected to the wearer's belt, such as disclosed in U.S. Pat. No. 4,821,933 issued to Seber. In some pouches or tool holders the tape rule device may be prevented from accidently falling out of or being accidently forced from the pouch or holder by a leather strap that is snap-connected to the pouch or holder. The inventor, however, has in time found this latter arrangement inconvenient in having to unsnap and then remembering to re-snap the leather strap in place. In the course of a day on the construction site, the tape rule device may have to be removed from its holder and replaced many times, and it is not always convenient and it is often distracting to be fumbling around without looking while trying to locate where the strap needs to be snapped in place again.

The opposite side walls of some tool holders for tape rule devices are tapered somewhat inwardly from the top opening to the bottom of the tool holder so that when the tape rule device is inserted by the wearer into the pocket of the tool holder, the tape rule device is forcibly moved by the wearer to its fully seated and wedged position within the pocket. Still, however, an accidental bump on the bottom of the tool holder will often cause a partial unintentioned dislodgment of the tape rule device from its fully seated and wedged position, and eventually the tape rule device may fall out of the pocket when the wearer is crawling over a roof, or is moving in a crouched position over a work site, or is leaning out of a window to accomplish some construction purpose.

In considering the various situations described above, and thinking about what would be most convenient to have in the way of a tool holder for carrying a tape rule device on the job without also having accidental dislodgments and the other distractions mentioned and without interfering with concentration on the work at hand on the job site, the inventor has developed what he believes to be a very practical and innovative tool holder for holding a tape rule device and by providing within the tool holder an arrangement by which the tape rule device is positively held within the pocket of the tool holder without fear of accidental dislodgment, and yet the tape rule device may by intention be easily slid into the tool holder and withdrawn therefrom with little conscious effort.

The inventor has provided within the pocket of the tool holder a retention member that cooperates with the spring clip member provided by manufacturers on the rear surface of a number of different tape rule devices, with the result that there is an interlocking engagement of the spring clip member with the retention member when the tape rule device is guided by the walls of the pocket as it is slid into the pocket of the tool holder. The spring clip member is readily and intentionally dislodged from such interlocking engagement with the retention member when the wearer moves his fingers into engagement with the bottom of the tape rule device through the opening provided at the bottom of the pocket of the tool holder and then moves the tape rule device upwardly from the pocket.

Although there are known hanger devices that have been employed on the outside of a multiple tool holding pouch, such as disclosed, for example, in FIG. 6 of Design Pat. No. 328,191, which issued to Reitz on Jul. 28, 1992, for supporting a tape rule device on the outside surface of the tool holder by the spring clip member on the tape rule device, as far as the inventor has been able to determine, it has apparently never occurred to manufacturers or to others to place such a hanger device on the inside of the pocket of the tool holder. It was probably thought that the pocket was sufficient by itself to retain the tape rule device without giving any thought as to what actually happens on the job in the situations described above.

When the retention member is used in the pocket of the tool holder, as disclosed by the inventor, it no longer performs the same function of support for the tape rule device as it does in the Reitz patent because the support function for the tape rule device is provided by the pocket itself when the tape rule device is in its fully seated position within the pocket of the tool holder. The retention member, therefore, then serves to interlock with the spring clip member on the rear surface of the tape rule device to prevent unintentioned dislodgment of the tape rule device.

The inventor, who is a carpenter and contractor, has still further found that the two tools that are most convenient always to have at hand and are used the most times are the tape rule device, as previously mentioned, and a hammer. When laying off a construction site, for example, the inventor uses the tape rule device to measure where wood stakes, for example, should be located, and then uses a hammer to drive the wood stakes into the ground, and may thereafter connect a string from stake to stake to establish straight guide lines therebetween for locating some construction activity to be initiated at that location. The inventor may also need to temporarily install partially driven nails in existing framing and then connect a string or cord between the nails to serve as guides for some other construction activity to be located at that site.

The inventor, therefore, has devised another embodiment of a tool holder that overcomes the objectionable features of some of the known tool holders, as described above, and which enables him to carry about his person the two most used tools in construction: a tape rule device and a hammer, as previously mentioned, or in some instances a hatchet instead of a hammer, in which case he may use the blunt end of the hatchet to drive in a wood stake or nail. In this manner also, the inventor is not burdened by carrying the weight of numerous other tools, and yet still he has the convenience of being able to carry on his person the two most often used tools in construction without fear of accidental dislodgment when climbing in and out of vehicles, or moving up and down ladders, climbing over roof surfaces, crouching, bending, hanging out over a window opening and making other similar movements. In this manner also, the inventor will have the assurance that the tools will remain with him, and that they may be quickly removed and replaced in the tool holder carried about his waist without conscious effort and attention.

Carrying devices for hammers and hatchets are already known in the prior art and they range from the formation of a simple cloth loop in one's work trousers for the insertion of the elongated handle therethrough of the hammer or hatchet, to specially designed leather holders, such as shown in Design Pat. No. 248,066 issued to Hillinger in 1978; in U.S. Pat. No. 4,106,679 issued to Hillinger in 1978; in Design Pat. No. 253,019 issued to Hillinger in 1979; and in U.S. Pat. No. 4,372,468 issued to Harvey in 1983.

The Hillinger patent, U.S. Pat. No. 4,106,679, for instance, discloses a tool support arrangement by which the hammer or hatchet is swivelly-connected to a pad that in turn is supported from a wearer's waist belt. The hammer or hatchet handle is inserted through a metal tool loop until the crosspiece (the head) of the hammer or hatchet comes to rest upon the top surface of the metal tool loop. The metal tool loop in turn is pivotally-connected or swivelly-connected to a pivot rod that extends at right angles from the pad so that the metal tool loop may be pivoted or swivelled about the pivot rod to facilitate insertion in the metal tool loop and removal from the metal tool loop of the hammer or hatchet.

The Harvey patent, U.S. Pat. No. 4,372,468, discloses a similar pivotal metal tool loop arrangement, with the exception that the metal tool loop is made up in part from a pair of spring-biased tool retention gates for rapid lateral entry of the handle of a hammer or hatchet into the metal tool loop. Since, however, the retention gates are designed to allow only pivotal inward movement and then pivotal outward movement only so far as to return to their retention position, the retention gates cannot be pivoted outwardly beyond their retention position to allow lateral retraction of the tool handle from the tool loop. Therefore, the hammer or hatchet must be withdrawn from the metal tool loop in the same manner as in the Hillinger patented construction.

BRIEF SUMMARY OF INVENTION

The present invention concerns a carpenter's tool holder adapted to be supported from a wearer's waist belt. The tool holder includes an essentially flat rear wall and an outwardly extending front wall connected to the flat rear wall and defining therebetween a pocket and an opening at the top of the pocket large enough to slidingly receive therethrough and into the pocket a tape rule device. The pocket is configured to support and contain therein the tape rule device. The tape rule device has an essentially flat rear surface and a spring clip member secured at its upper end to the rear surface of the tape rule device. The spring clip member has an elongated tongue extending downwardly from its location of securement to the flat rear surface of the tape rule device and defines adjacent to its lower end an inwardly extending curved portion spring-biased to bear against the rear surface of the tape rule device. The elongated tongue of the spring clip member has at its free end a tip portion that is curved outwardly from the aforementioned inwardly curved portion to form an engaging surface. A retention member is connected to the front surface of the rear wall of the pocket of the tool holder and faces the rear surface of the outwardly extending front wall of the pocket and is adapted to receive between the retention member and the rear wall of the pocket the elongated tongue of the spring clip member of the tape rule device in interlocking engagement with the retention member when the tape rule device is slid into the pocket through its top opening and by which the tape rule device is releasably interlocked and retained in the pocket of the tool holder.

The retention member for the tape rule device is positioned within the pocket of the tool holder and is connected to the rear wall of the pocket. The retention member horizontally extends a portion of the way along and is generally parallelly spaced from the rear wall of the pocket of the tool holder.

The retention member for the tape rule device is positioned within the pocket of the tool holder and is connected to and horizontally extends a portion of the way along the rear wall of the pocket. Intermediate of its length, the retention member is spaced generally parallel from the rear wall of the pocket and is at right angles with respect to the elongated tongue of the spring clip member on the tape rule device when the tape rule device is slidingly received in the pocket of the tool holder.

The retention member for the tape rule device defines a horizontally extending hanger bar generally parallelly spaced from the rear wall of the pocket of the tool holder and is secured at its ends to the rear wall of the pocket and adapted to interlockingly engage at a generally right angle with the elongated tongue of the spring clip member of the tape rule device when the tape rule device is slidingly received in the pocket of the tool holder.

The horizontally extending hanger bar may also define along its bottom edge a lip that is turned upwardly at an angle and is adapted to bear against the rear surface of the tape rule device when the tape rule device is slidingly received in the pocket of the tool holder and becomes supported, releasably interlocked and retained within the pocket of the tool holder so as to provide further resistance against unintentioned dislodgment of the tape rule device from the pocket of the tool holder.

The carpenter's tool holder has a pocket that defines an opening adjacent its bottom portion through which the wearer may insert the fingers of the wearer's hand to intentionally dislodge the spring clip member of the tape rule device from the retention member and to move upwardly out of the pocket the tape rule device when the tape rule device is within the pocket of the tool holder.

In a second embodiment of the invention, the carpenter's tool holder may also include a supporting member for a hammer and is attached to the tool holder at a location spaced below the pocket of the tool holder. The supporting member comprises a pivot member pivotally connected with respect to the tool holder at essentially right angles with respect to the flat rear wall of the tool holder. An elongated hanger member, which is adapted to support the hammer, is pivotally connected at its upper end portion to the pivot member and defines at its lower end portion a tool loop and an opening in the tool loop large enough and through which the handle of the hammer may be inserted. The elongated hanger member also defines a planar top surface on the tool loop that is essentially at right angles with respect to the flat rear wall of the tool holder for supporting across the planar top surface the head of the hammer when the handle of the hammer is inserted through the opening in the tool loop.

The supporting member for a hammer defines a vertically extending flat connecting member that is connected to the tool holder for supporting the supporting member from the tool holder.

The vertically extending flat connecting member of the supporting member for a hammer is connected to the tool holder between the flat rear wall and the pocket of the tool holder.

The supporting member for a hammer includes a horizontally extending rectangular box positioned against the flat rear wall of the tool holder and that is closed at its top and both ends and defines at its bottom a rectangular opening for enabling the elongated hanger to extend downwardly through the rectangular opening of the horizontally extending box.

The pivot member of the supporting member is pivotally connected to the horizontally extending rectangular box.

DESCRIPTION OF THE PREFERRED EMBODIMENT

Figure 1:
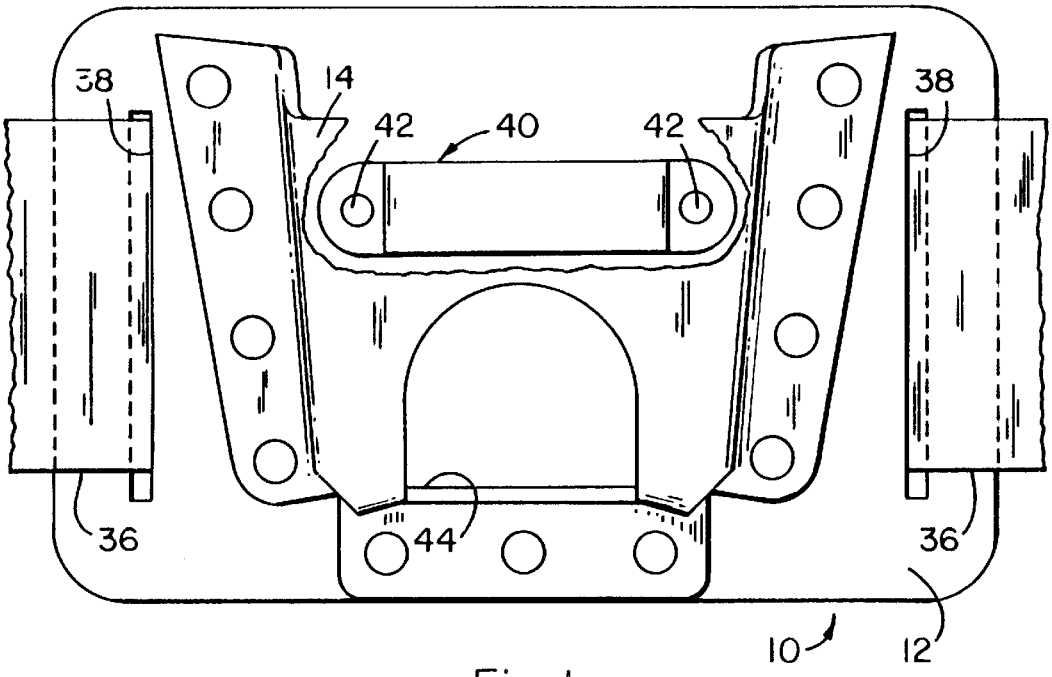
FIG. 1 is a front elevational view of the carpenter's tool holder of the invention, with the front wall of the tool holder being partly broken away to illustrate the retention member for a tape rule device (not shown)
Figure 2:
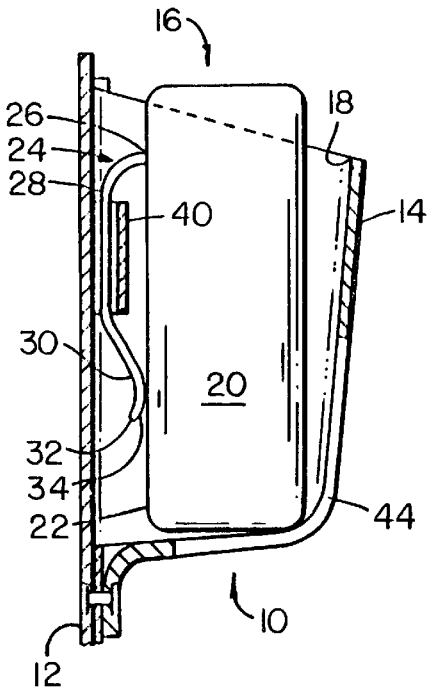
FIG. 2 is a side elevational view of the carpenter's tool holder shown in FIG. 1, and shows partly in cross-section the interlocking engagement of the spring clip member of a tape rule device, which is slidably received within the pocket of the tool holder, with the retention member that is secured to the rear wall of the tool holder.

In reference to FIGS. 1 and 2 of the drawings, the carpenter's tool holder of the invention is shown at 10 and may be fabricated from leather or other suitable materials. The tool holder comprises an essentially flat rear wall 12 and an outwardly extending front wall 14 that is connected to the flat rear wall 12. The flat rear wall 12 and the outwardly extending front wall 14 define between them a pocket 16 and an opening 18 at the top of the pocket large enough to receive in sliding relation therethrough and into the pocket a tape rule device 20. The pocket 16 is configured to support and contain therein the tape rule device 20.

The tape rule device 20 has an essentially flat rear surface 22 and a spring clip member 24, which is secured at its upper end 26 to the rear surface 22 of the tape rule device.

The spring clip member 24 has an elongated tongue 28, which extends downwardly from its location of securement to the flat rear surface 22 of the tape rule device. The elongated tongue defines adjacent to its lower end an inwardly extending curved portion 30 that is spring-biased to bear against the rear surface of the tape rule device, and has at its free end a tip portion 32 that is curved outwardly from the inwardly extending curved portion 30 to form a sliding engagement surface 34. The sliding engagement surface facilitates the downward insertion of the spring clip member over the wearer's waist belt 36 that extends through the pair of slots 38 that may be formed through the rear wall 12 of the carpenter's tool holder 10.

A retention member 40 is connected at its opposite ends, as by rivets 42 or other suitable means, to the front surface of the rear wall 12 of the pocket, as shown, for example, in FIG. 1. The retention member is adapted to receive between it and the rear wall 12 of the tool holder the elongated tongue 28 of the spring clip member 24 of the tape rule device in interlocking engagement with the retention member when the tape rule device is slid into the pocket 16 through the top opening 18. In this manner, the spring clip member, which is positioned at right angles with respect to the horizontally extending retention member, thereby releasably locks the tape rule device and retains it in the pocket of the tool holder 10.

As will be noted from the drawings, the retention member 40 horizontally extends a portion of the way along the rear wall 12 of the pocket of the tool holder 10. Intermediate of the length of the retention member, that is between the two connecting rivets 42, the retention member is positioned generally parallel with respect to and spaced from the rear wall 12 of the tool holder as well as being at right angles with respect to the elongated tongue 26 of the spring clip member 24 when the tape rule device is slidingly received within the pocket of the tool holder. The retention member in effect defines a horizontally extending hanger bar, which is generally parallelly spaced from the rear wall of the tool holder 10, as previously mentioned.

The pocket 16 of the tool holder also defines an opening 44 adjacent its bottom portion and through which the wearer may insert the fingers of the wearer's hand to intentionally dislodge the spring clip member of the tape rule device from the retention member and to move upwardly out of the pocket the tape rule device when the tape rule device is within the pocket of the tool holder 10.

Figure 3:
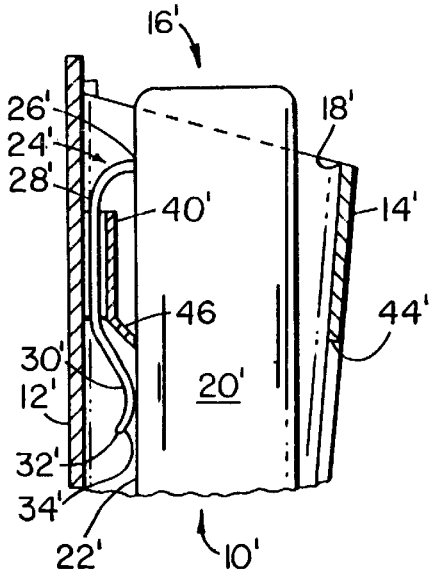
FIG. 3 is a view similar to that shown in FIG. 2, but partly broken away at the bottom portion, and shows a modification of the retention member, which is provided with an upturned lip that bears against the rear surface of the tape rule device so as to enhance the retention of the tape rule device within the pocket of the tool holder.

In reference to FIG. 3, in which like elements have been identified with the same reference numbers as employed in FIGS. 1 and 2 but with each of the corresponding reference numbers being distinguished from FIGS. 1 and 2 with the addition of a prime mark after the corresponding reference number, a modification of the retention member is disclosed. The hanger bar or retention member 40' defines along its bottom edge a lip 46. which is turned to extend upwardly at an angle, and in this manner is adapted to bear against the rear surface 22' of the tape rule device 20' when the tape rule device is slidingly received within the pocket 16' and becomes supported, releasably interlocked and retained within the pocket of the tool holder 10' so as to provide a further resistance against unintentioned dislodgment of the tape rule device from the pocket of the tool holder.

Figure 4:
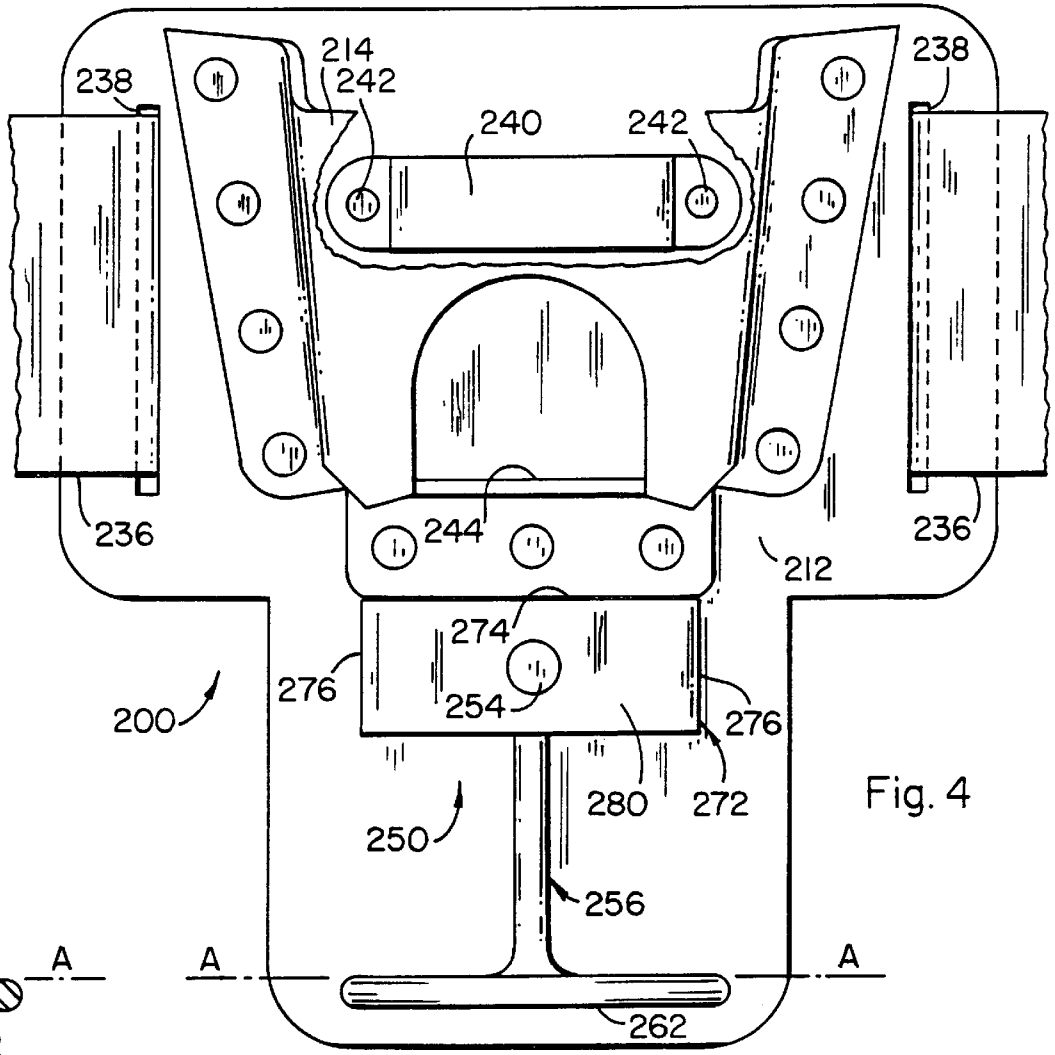
FIG. 4 is a front elevational view of another embodiment of the carpenter's tool holder shown in FIG. 1, and illustrates the provision of a supporting member for a hammer that is positioned below the pocket for a tape rule device.
Figure 5:
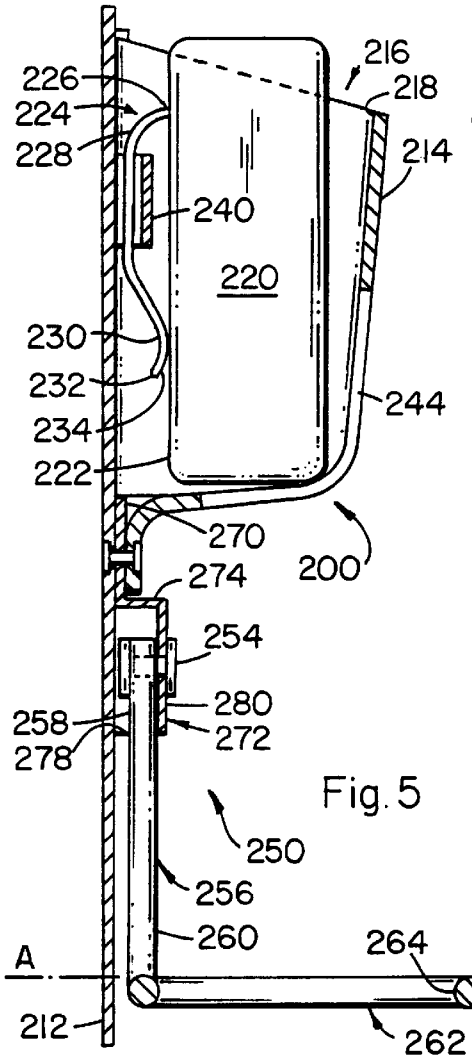
FIG. 5 is a side elevational view of the embodiment shown in FIG. 4 and similar to that shown in FIG. 2 except for the provision of a supporting member for a hammer positioned below the pocket for the tape rule device.
Figure 6:
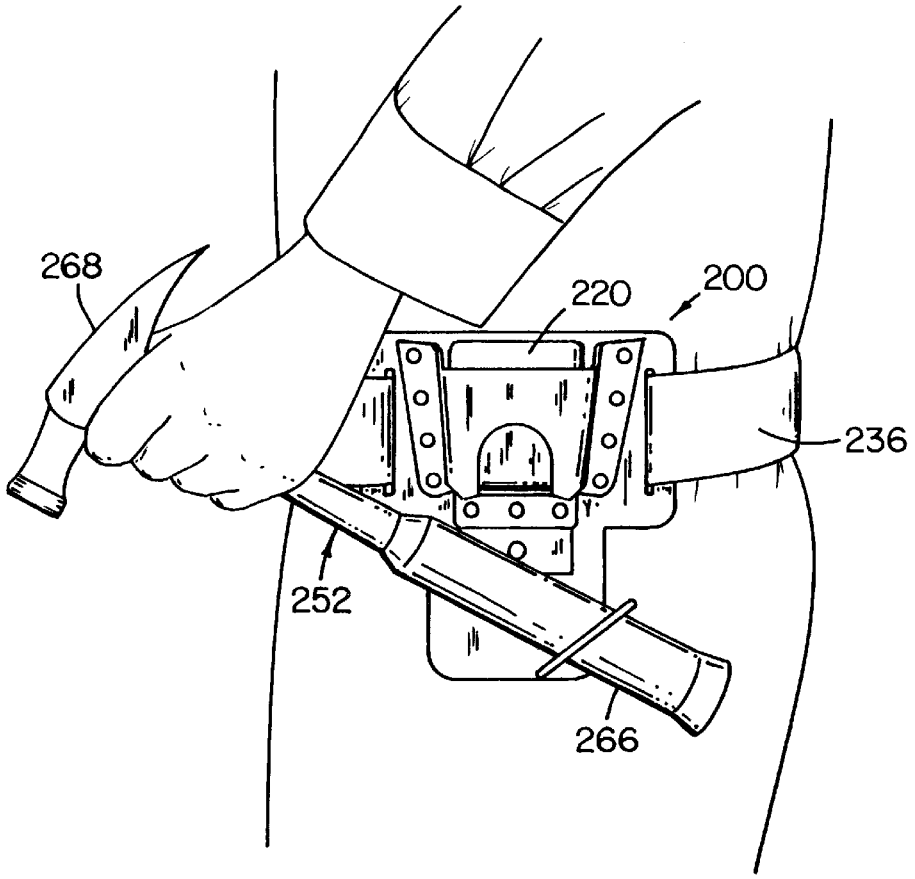
FIG. 6 is a side elevational view of the tool holder, as being worn on the waist belt of the wearer, and illustrating one possible manner of removal of a hammer from the tool holder.

In reference to FIGS. 4–6, wherein a second embodiment of the invention is disclosed, the carpenter's tool holder of the invention is shown at 200 and may also be fabricated from leather or other suitable materials. The tool holder comprises an essentially flat rear wall 212 and an outwardly extending front wall 214 that is connected to the flat rear wall 212. The flat rear wall 212 and the outwardly extending front wall 214 define between them a pocket 216 and an opening 218 at the top of the pocket large enough to receive in sliding relation therethrough and into the pocket a tape rule device 220. The pocket 216 is configured to support and contain therein the tape rule device 220.

The tape rule device 220 has an essentially flat rear surface 222 and a spring clip member 224, which is secured at its upper end 226 to the rear surface 222 of the tape rule device.

The spring clip member 224 has an elongated tongue 228, which extends downwardly from its location of securement to the flat rear surface 222 of the tape rule device. The elongated tongue defines adjacent to its lower end an inwardly extending curved portion 230 that is spring-biased to bear against the rear surface of the tape rule device, and has at its free end a tip portion 232 that is curved outwardly from the inwardly extending curved portion 230 to form a sliding engagement surface 234. The sliding engagement surface facilitates the downward insertion of the spring clip member over the wearer's waist belt 236 that extends through the pair of slots 238 that may be formed through the rear wall 212 of the carpenter's tool holder 200. In this manner the waist belt may be slipped between the spring clip member 224 and the rear surface of the tape rule device 220.

A retention member 240 is connected at its opposite ends, as by rivets 242 or other suitable means, to the front surface of the rear wall 212 of the pocket, as shown, for example, in FIG. 4. The retention member is adapted to receive between it and the rear wall 212 of the tool holder the elongated tongue 228 of the spring clip member 224 of the tape rule device in interlocking engagement with the retention member when the tape rule device is slid into the pocket 216 through the top opening 218. In this manner, the spring clip member, which is positioned at right angles with respect to the horizontally extending retention member, thereby releasably locks the tape rule device and retains it in the pocket of the tool holder 200.

As will be noted from the drawings, the retention member 240 horizontally extends a portion of the way along and is generally parallelly spaced from the rear wall 212 of the pocket of the tool holder 200. Intermediate of the length of the retention member, that is between the two connecting rivets 242, the retention member is positioned, as aforementioned, generally parallel with respect to the rear wall 212 of the tool holder as well as being at right angles with respect to the elongated tongue 226 of the spring clip member 224 when the tape rule device is slidingly received in the pocket of the tool holder. The retention member in effect defines a horizontally extending hanger bar, which, as mentioned previously, is generally parallelly spaced from the rear wall 212 of the tool holder 200.

The pocket 216 of the tool holder also defines an opening 244 adjacent its bottom portion and through which the wearer may insert the fingers of the wearer's hand to intentionally dislodge the spring clip member of the tape rule device from the retention member by moving upwardly out of the pocket the tape rule device when the tape rule device is within the pocket of the tool holder 200.

Attached to the tool holder 200 and located below the pocket 216 is a supporting member 250, preferably adapted for a hammer, such as shown at 252 in FIG. 6, or it may also serve to support a hatchet.

A pivot member 254 is pivotally connected with respect to the tool holder at essentially right angles with respect to the flat rear wall 222 of the tool holder 200.

An elongated hanger member 256 adapted to support a hammer is pivotally connected at its upper end portion 258 to the pivot member 254 and defines at its lower end portion 260 a tool loop 262 and an opening 264 in the tool loop that is large enough and through which the handle, such as handle 266 shown in FIG. 6, of a hammer may be inserted. The elongated hanger member 256 also defines a planar top surface A—A on the tool loop that is essentially at right angles with respect to the flat rear wall 212 of the tool holder 200 for supporting across the planar top surface the head of a hammer, such as head 268 of the hammer 252 shown in FIG. 6, when the handle of a hammer is inserted through the opening 264 in the tool loop 262.

The supporting member 250 for a hammer defines a vertically extending flat connecting member 270 that is connected to the tool holder for supporting the supporting member from the tool holder.

The vertically extending flat connecting member 270 of the supporting member 250 is preferably connected to the tool holder between the flat rear wall 212 and the pocket 216 of the tool holder 200.

The supporting member 250 includes a horizontally extending rectangular box 272 that is positioned against the flat rear wall 212 of the tool holder 200 and that is closed at its top 274 and both ends 276, and defines at its bottom a rectangular opening 278 for enabling the elongated hanger member 256 to extend downwardly through the rectangular opening 278 of the horizontally extending rectangular box 272. The length of the horizontally extending rectangular box and its bottom opening 278 enables the elongated hanger member 256 a large latitude for pivoting or swivelling from one end 276 to the other end 276 of the horizontally extending rectangular box to facilitate removal of the hammer from the tool loop 262 or replacement of the hammer in the tool loop.

The pivot member 254 is pivotally connected to the horizontally extending box, as shown, for example, in FIGS. 4 and 5 in the drawings. For instance, the pivot member may extend through the front wall 280 of the horizontally extending rectangular box 272.

The elongated hanger member 256 is readily pivoted or swivelled about the pivot member 254 so that the hammer by gravity remains in an essentially upright position when the wearer is bending or crouching on the job. In this manner, the hammer does not fall out of the tool support. On the other hand, the wearer may easily remove the hammer from the tool loop 262 by grasping the hammer in the manner shown in FIG. 6 and freely pivot or swivel it about its axis of support. The elongated hanger member is made long enough to provide sufficient space between the head 268 of the hammer 252 and the bottom of the pocket 216 of the tool holder 200. In this manner, when the hammer is removed from or replaced in the tool loop 262, there will be no interference of the hammer with the pocket.

Figure 7:
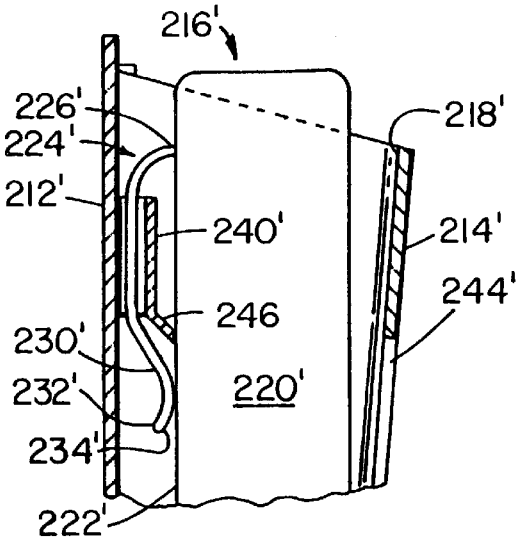
FIG. 7 is a side elevational view of the embodiment of FIG. 4, but partially broken away at the bottom portion, and showing a modification of the retention member by forming an upturned lip on the retention member in the manner shown in FIG. 3.

In reference to FIG. 7, in which like elements have been identified with the corresponding reference numbers as employed in FIGS. 4–6, but with each of the corresponding reference numbers being distinguished from those used in FIGS. 4–6 with the addition of a prime mark after the corresponding reference numbers, a modification of the retention member is disclosed. The hanger bar or retention member 240' defines along its bottom edge a lip 244, which is turned upwardly at an angle, and in this manner is adapted to bear against the rear surface 222' of the tape rule device 220' when the tape rule device is slidingly received within the pocket 216' of the tool holder 200' to provide a further resistance against unintentioned dislodgment of the tape rule device from the pocket of the tool holder.

The invention has been described in detail with particular reference to preferred embodiments thereto, but it will be understood that variations and modifications can be effected within the spirit and scope of the invention.

I claim:

1. A carpenter's tool holder adapted to be supported from a wearer's waist belt and comprising an substantially flat rear wall and an outwardly extending front wall connected to said flat rear wall and defining therebetween a pocket and an opening at the top of said pocket large enough to slidingly receive therethrough and into said pocket a tape rule device, said pocket being configured to releasably support and contain therein the tape rule device, the tape rule device having a substantially flat rear surface and an elongated spring tongue clip member extending downwardly from its location of securement on the tape rule device;

a retention means connected to the front surface of said rear wall of said pocket of the tool holder and facing the rear surface of said outwardly extending front wall of said pocket and adapted for receiving between said retention means and said rear wall of said pocket the elongated tongue of said spring clip member of said tape rule device in interlocking engagement with said retention means when said tape rule device is slid into said pocket through said top opening and by which said tape rule device is releasably interlocked and retained in said pocket of the tool holder.

2. A carpenter's tool holder as defined in claim 1, and wherein said retention means connected to said rear wall of said pocket horizontally extends a portion of the way along and is spaced generally parallel from the rear wall of the pocket of the tool holder.

3. A carpenter's tool holder as defined in claim 1, and wherein said retention means is connected to and horizontally extends a portion of the way along the rear wall of said pocket and is intermediate of its length spaced generally parallel from said rear wall of said pocket and at right angles with respect to said elongated tongue of the spring clip member on said tape rule device when said tape rule device is slidingly received in the pocket of the tool holder.

4. A carpenter's tool holder as defined in claim 1, and wherein said retention means connected to said rear wall of said pocket defines a horizontally extending hanger bar generally parallelly spaced from said rear wall of said pocket and secured at its ends to said rear wall of said pocket and adapted to interlockingly engage at a generally right angle with the elongated tongue of said spring clip member of said tape rule device when said tape rule device is slidingly received in the pocket of the tool holder.

5. A carpenter's tool holder as defined in claim 4, and wherein said horizontally extending hanger bar defines along its bottom edge a lip that is turned to extend upwardly at an angle and is adapted to bear against the rear surface of said tape rule device when said tape rule device is slidingly received in said pocket and becomes supported, releasably interlocked and retained within said pocket so as to provide a further resistance against unintentioned dislodgment of said tape rule device from the pocket of the tool holder.

6. A carpenter's tool holder as defined in claim 1, and wherein said pocket defines an opening adjacent its bottom portion through which the wearer may insert the fingers of the wearer's hand to intentionally dislodge said spring clip member of the tape rule device from said retention means and to move upwardly out of the pocket said tape rule device when said tape rule device is within the pocket of the tool holder.

7. A carpenter's tool holder as defined in claim 1, and wherein said tool holder also includes a supporting means for a hammer and is attached to said tool holder at a location spaced below the pocket of the tool holder, said supporting means comprising a pivot member pivotally connected with respect to said tool holder at substantially right angles with respect to said flat rear wall of said tool holder, an elongated hanger member adapted to support said hammer and being pivotally connected at its upper end portion to said pivot member and defining at its lower end portion a tool loop and an opening in said tool loop large enough and through which the handle of said hammer may be inserted, said elongated hanger member also defining a planar top surface on said tool loop that is essentially at right angles with respect to said flat rear wall of said tool holder for supporting across said planar top surface the head of said hammer when said handle is inserted through the opening in said tool loop.

8. A carpenter's tool holder as defined in claim 7, and wherein said supporting means for said hammer defines a vertically extending flat connecting member that is connected to said tool holder for supporting said supporting means from said tool holder.

9. A carpenter's tool holder as defined in claim 8, and wherein said vertically extending flat connecting member of said supporting means for said hammer is connected to said tool holder between said flat rear wall and said pocket of said tool holder.

10. A carpenter's tool holder as defined in claim 7, and wherein said supporting means for said hammer includes a horizontally extending rectangular box positioned against said flat rear wall of said tool holder and that is closed at its top and both ends and defines at its bottom a rectangular opening for enabling said elongated hanger member to extend downwardly through said rectangular opening of said horizontally extending box.

11. A carpenter's tool holder as defined in claim 10, and wherein said pivot member is pivotally connected to said horizontally extending rectangular box.

* * * * *